US007976699B2

(12) United States Patent
Kesler

(10) Patent No.: US 7,976,699 B2
(45) Date of Patent: Jul. 12, 2011

(54) DISTILLATION APPARATUS AND METHOD OF USE

(76) Inventor: Michael L. Kesler, Lindon, UT (US)

( * ) Notice: Subject to any disclaimer, the term of this patent is extended or adjusted under 35 U.S.C. 154(b) by 1013 days.

(21) Appl. No.: 11/762,741

(22) Filed: Jun. 13, 2007

(65) Prior Publication Data

US 2008/0173531 A1 Jul. 24, 2008

Related U.S. Application Data

(60) Provisional application No. 60/814,448, filed on Jun. 16, 2006, provisional application No. 60/887,883, filed on Feb. 2, 2007.

(51) Int. Cl.
*C10M 175/00* (2006.01)

(52) U.S. Cl. ..... 208/184; 208/179; 208/347; 208/349

(58) Field of Classification Search ..... None
See application file for complete search history.

(56) References Cited

U.S. PATENT DOCUMENTS

| | | | | |
|---|---|---|---|---|
| 2,892,759 | A | 6/1959 | Nerheim | |
| 3,232,847 | A | 2/1966 | Hoff | |
| 3,607,662 | A | 9/1971 | Glover | |
| 4,406,743 | A | 9/1983 | MacQueen et al. | |
| 4,512,878 | A * | 4/1985 | Reid et al. | 208/179 |
| 4,945,937 | A | 8/1990 | Scribner | |
| 5,573,656 | A | 11/1996 | Santos | |
| 5,853,563 | A | 12/1998 | Ripley et al. | |
| 6,068,759 | A | 5/2000 | Moore et al. | |
| 6,106,699 | A | 8/2000 | MacDonald et al. | |
| 6,117,309 | A | 9/2000 | Daspit et al. | |
| 6,132,596 | A | 10/2000 | Yu | |
| 6,440,298 | B1 * | 8/2002 | Shurtleff | 208/179 |
| 2002/0036158 | A1 | 3/2002 | Austin | |

FOREIGN PATENT DOCUMENTS

| | | |
|---|---|---|
| EP | 0940466 | 9/1999 |
| WO | WO 94/07798 | 5/1994 |
| WO | WO 97/27273 | 7/1997 |
| WO | WO 99/55810 | 11/1999 |
| WO | WO-2010050901 A1 * | 5/2010 |

OTHER PUBLICATIONS

Mann, "A Comprehensive Technical Handbook On Motor Oil, Lubrication and Filtration" ebook, Feb. 26, 2003, Table of Contents, pp. 4-7.

* cited by examiner

*Primary Examiner* — Tam M Nguyen
(74) *Attorney, Agent, or Firm* — Warren M. Pate, LLC

(57) ABSTRACT

A method and apparatus is provided for distilling and processing chemicals. The apparatus is particularly suited for processing and distilling difficult to distill compounds, and is capable of producing diesel fuel and other products from used oil at a quality level similar to that of products produced from virgin crude oil.

20 Claims, 8 Drawing Sheets

DISTILLATION APPARATUS AND METHOD OF USE

RELATED APPLICATIONS

This application claims the benefit of co-pending U.S. Provisional Patent Application Ser. No. 60/814,448 filed Jun. 16, 2006 and U.S. Provisional Patent Application Ser. No. 60/887,883 filed Feb. 2, 2007. Both U.S. Provisional Patent Application Ser. No. 60/814,448 filed Jun. 16, 2006 and U.S. Provisional Patent Application Ser. No. 60/887,883 filed Feb. 2, 2007 are incorporated by reference herein.

BACKGROUND

1. The Field of the Invention

The present invention relates to distillation. More specifically, the present invention relates to a method and system for distillation which provides improved results in distilling mixtures which are difficult to distill. Additionally, the present invention provides a method and system which are effective in treating used oil, and which are effective in producing fuels such as diesel fuel from used oil including used motor oil. The present invention further provides an apparatus and methods for improving production and efficiency at an oil well.

2. The Background Art

Currently, used oil is undesirable as it has limited use. The processing and refinement of used oil including used motor oil has been limited to filtering the oil through a screen, dewatering the oil, and selling the oil as burner oil. Such a process is certainly advantageous over disposal of the oil, but has several limitations.

Used oil typically contains a significant amount of contaminants such as motor oil additives, ash, metal particles, sulfur, etc. Such impurities typically make it more difficult to use the oil as a fuel. These impurities may increase the emissions released from burning the oil, as well as making it more difficult to operate the burner. Additionally, burner oil is inexpensive and as such it would be advantageous if the used oil could be converted into a move valuable product such as diesel fuel instead of simply using the oil as a burner oil.

Several problems have prevented the refining of used oil to produce diesel fuel or other refined products. One problem is that the used oil contains significant impurities such as ash, metals, motor oil additives, etc. which are not easily removed from the oil. Such impurities may be undesirable if present in a refined oil product, and may impede the refining process, such as by inducing coking inside of distillation vessels. Another problem encountered in refining used oil (which are black in color) is that when distilled into the appropriate cuts, the fuels (diesel typically distills as a light amber liquid even from used oil) and products thus distilled are unstable and quickly oxidize and turn black again, and are generally of inferior quality.

There is thus a need for a method and apparatus which overcomes the limitations of available refining processes. Specifically, there is a need for a method and apparatus for refining and distilling difficult to separate mixtures, and in particular there is a need for a method and apparatus for refining used oil to produce fuels and usable oil which are stable and of quality comparable to fuels distilled from virgin crude oil.

BRIEF SUMMARY OF THE INVENTION

It is an object of the present invention to provide an improved method, system, and apparatus for refining and distilling chemicals. It is a further object of the present invention to provide an improved method, system, and apparatus for refining used oil, and for producing fuels from used oil comparable in quality to fuels produced from virgin crude oil.

According to one aspect of the invention, a separation unit is provided which is capable of chemically removing impurities from used oil. The separation unit is capable of removing impurities such as motor oil additives, metals, ash, etc. economically and with high efficiency.

According to another aspect of the invention, a distillation unit is provided which can successfully and easily distill mixtures which are difficult to distill with conventional distillation equipment. The distillation unit may be operated as a single unit, or as a series of distillation units depending on the feed material and desired product.

According to another aspect of the present invention, methods are provided for distilling and refining used oil including lubrication oil and motor oil. These methods include methods for removing impurities from the oil, methods for stabilizing the oil, and methods for separating the oil into desired products by distillation.

These and other aspects of the present invention are realized in a distillation apparatus, method, and system as shown and described in the following figures and related description.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

Figure 1:
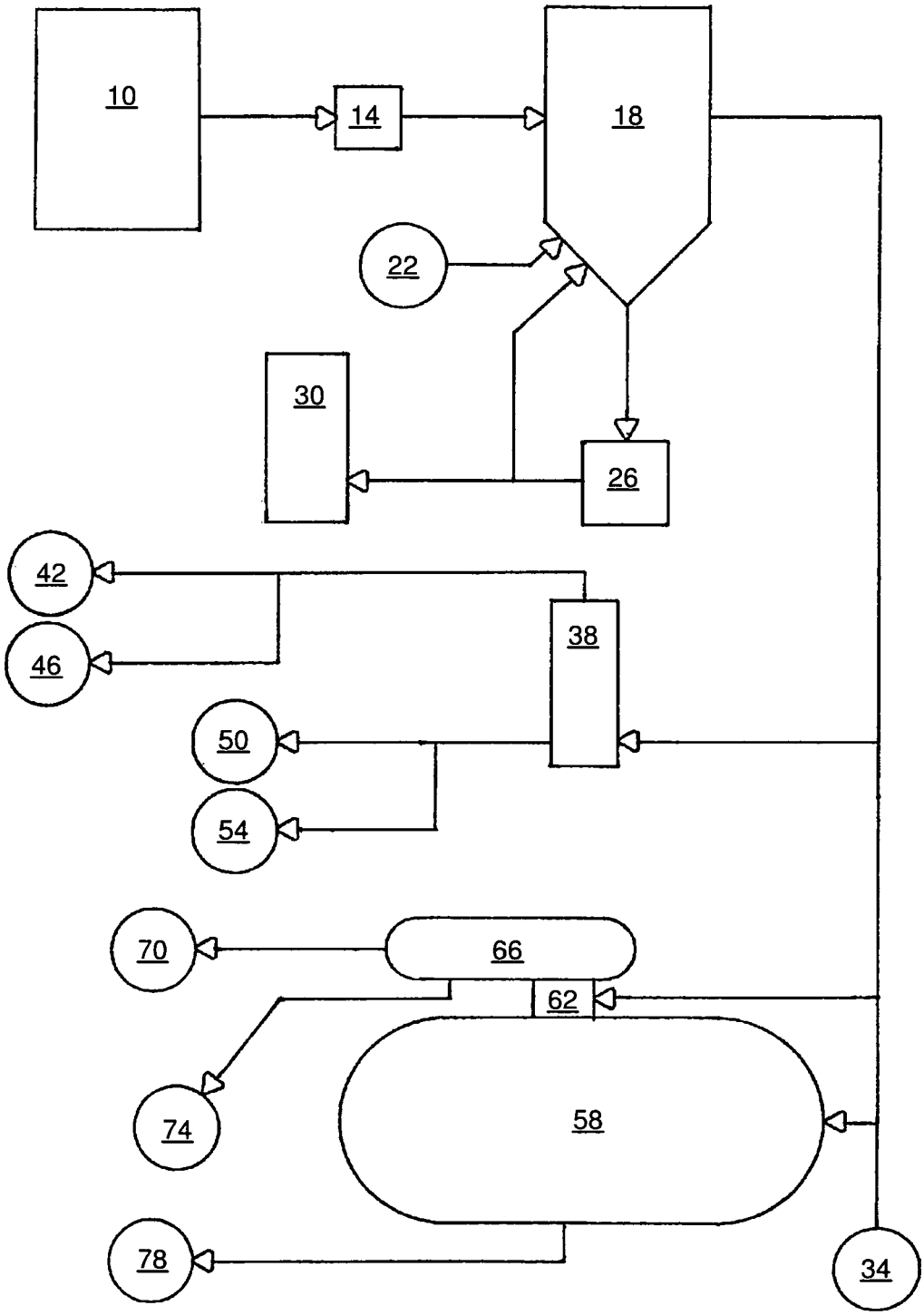
FIG. 1 shows a process diagram for a system according to the present invention.

It will be appreciated that the various embodiments shown accomplish various aspects and objects of the invention. It is appreciated that not all aspects of the invention may be clearly shown in a single FIGURE. Thus, multiple figures may be used to illustrate the various aspects of a single embodiment of the invention.

DETAILED DESCRIPTION OF THE INVENTION

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of the invention. The illustrated embodiments of the invention will be best understood by reference to the drawings, wherein like parts are designated by like numerals throughout.

Turning now to FIG. 1, a process diagram for a system according to the present invention is shown. In discussing the present invention, the Figures show the various pieces of equipment as various sizes of geometric shapes which roughly correspond to the equipment. Additionally, the figures use circles to designate supplies of feed or chemicals, destinations of products or chemicals such as holding tanks, etc. Connecting arrows with triangular heads are used to designate the general flow paths of chemicals through the system. Instrumentation such as pressure gauges, temperature gauges, etc. and the equipment used to monitor such system conditions and to control the system are generally not discussed herein as the invention relates to novel equipment and novel methods of operating such equipment, and not to novel instrumentation or process control equipment. The instrumentation and control equipment is known in the art and is understood as part of the system as necessary or desirable to accomplish the methods of operation discussed herein.

The system generally includes holding tanks 10 or the equivalent where feed stock may be received, held, and introduced into the system as desired. Such feed tanks may include multiple tanks or holding areas, and may also include equipment for heating or cooling the feed as necessary, and for mixing the feed materials. The system also typically includes a filter 14. It is appreciated that a filter is desirable when processing used oil as the oil may contain large solids or particulate contaminants which are best removed before further processing of the oil. Filters such as 30 mesh screen filters are often adequate for screening oil to produce burner oil. Finer filters such as 60 mesh screens or even finer may be used, and may allow for easier processing of the oil. A low pressure vibratory screen filter with a 60 mesh screen has been used satisfactorily to remove particulate contaminants from used oil.

The next step in processing used oil is typically that of removing ash and other contaminants which cannot be removed by a filter screen. As such, the oil is typically introduced into a large separation and mixing tank 18. The mixing tank 18 may advantageously be a large cone bottom tank, and may often be lined to prevent corrosion. Chemicals 22 may be introduced into the tank to remove contaminants from the oil, including ash, metals, etc. The oil is typically then separated from the chemicals, and the chemicals may be filtered 26, and reused in decontaminating additional oil in the tank 18. If the chemicals are water based, they may be neutralized after reuse is no longer economical and sent to a cooling tower 30. The oil may be sent to a holding or product tank 34 if desired, or may be directly introduced into other parts of the system.

The oil may be introduced into a molecular sieve 38. The molecular sieve separates by molecular size. A molecular sieve has been developed which used stacks of porous membranes inside of a cylindrical chamber to separate the oil. The oil is introduced under pressure and smaller molecules in the oil pass through the pores in the membrane and may be collected as permeate and stored as a product 42, or further processed 46. The permeability and flow of the oil through the membrane depends of the viscosity of the oil, temperature, pressure, etc. It has been found that the molecular sieve is capable of separating a usable diesel fuel and similar molecular weights oil molecules from the heavier oil and the colloids present in the used oil by using filtration limits of between 5,000 and 30,000 Daltons.

Pressures of between 100 and 1,000 psi have been found to be effective, and temperature has been found to be the most influential parameter in controlling the permeate characteristics and flow rate. A temperature range of between 150° F. and 200° F. has been determined to be a useful working range. Higher temperatures may be detrimental to the life of the membrane. The concentrate (residue not permeable through the membranes) is now of a higher molecular weight than the feed oil, and is released in a controlled manner from the molecular sieve to allow new oil to enter the sieve and to sweep larger molecules and contaminants away from the membranes. The molecular sieve 38 may also be mounted to a vibrator to aid in removing contaminants and large molecules from the membranes and prevent clogging of the membrane pores. The concentrate may also be sent to a product storage tank 50 or sent to another part of the system for further processing 54.

Membrane separation using the molecular sieve has proven to be an effective method of separating used oil into a diesel fuel and a residual oil. Limitations of the membrane separation technique include the relatively slow rate of permeate production, the high pressures required for operation, and the expense of the membranes. It may be useful, however, for separating fractions of the oil which prove to be difficult to separate otherwise.

Another part of the present system is a distillation unit 58. For simplicity in creating the present drawing, the distillation unit is shown as a single distillation pot. It is appreciated, however, that the system may include any number of distillation pots depending on the types of chemicals to be distilled, the number of distinct products to be separated from a chemical mixture, the desired production rates, etc. A single distillation pot is useful for batch distillation and semi-continuous or continuous distillation, while multiple distillation pots allow for semi-continuous and continuous distillation while separating the oil into additional fractions or cuts. These aspects of the present system are shown and discussed in greater detail in subsequent figures, as they may not be clearly shown in the present FIGURE.

The distillation unit 58 includes a distillation column 62 and a condenser 66. Oil may be fed into the distillation pot 58 or the distillation column 62. The distillation unit typically produces non-condensable gasses 70, condensed product 74, and bottoms product 78. The details of the distillation unit and operation of the unit will be discussed in greater detail below.

In operating the system, the oil may be processed in many different ways. The oil may be first processed in the separating tank 18 to remove contaminants and then passed through the molecular sieve 38 or distillation unit 58. The products of the molecular sieve may be distilled. The oil or other chemicals may be processed through the molecular sieve or distillation pot 58 without initial processing in the separation tank 18. It is appreciated, however, that processing in the separation tank 18 to remove contaminants may make it easier to process the material in the molecular sieve 38 or distillation pot 58.

For processing used oil, it is typically desirable to remove contaminants in the separation tank 18 and then distill the oil. Distilling and separating used oil also leaves many options. The used oil may be separated in many different fractions and processed many different ways as will be discussed below. The equipment of the present invention allows for the refining of used oils to produce many products not previously possible.

Figure 2:
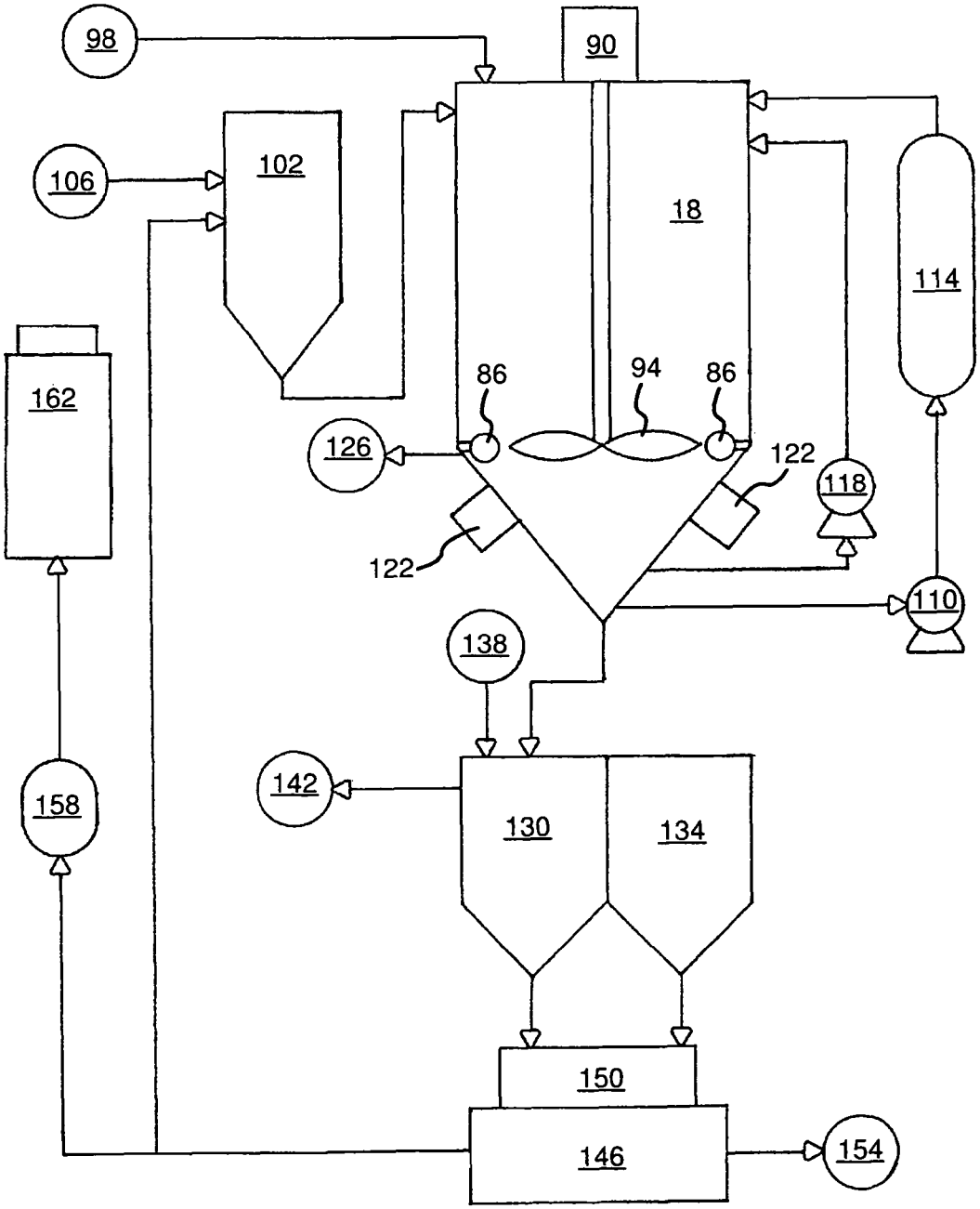
FIG. 2 shows a process diagram for the deashing and separating portion of the system of FIG. 1.

Turning now to FIG. 2, a process diagram detailing the separation tank 18 of FIG. 1 and associated equipment is shown. The separation tank 18 is typically a cylindrical cone bottom tank. Such a tank shape is advantageous for mixing and separation of immiscible liquid phases. The operation of the separation tank 18 and the associated equipment will be described relative to the processing of used oil, as the system is particularly suited for this.

The presently used tank has a volume of about 25,000 gallons in the cylinder and about 5,600 gallons in the cone. The tank is lined with a polyurea lining. Six mixing plates 86 are mounted on the walls of the tank 18, and a 30 hp mixer 90 is mounted to the tank and connected to a mixing blade or impeller 94. The mixing blade 94 is typically operated at about 200 rpm. The mixing plates 86 help in preventing the liquids in the tank 18 from merely rotating in a circle with the mixing blade 94, and thereby increase mixing in the tank 18.

The tank is typically filled with about 25,000 gallons of used oil 98, which has typically been passed through a filter such as filter 14 discussed above. A solvent tank 102 is filled with water 106 to which about 4000 ppm of $H_2SO_4$ is added. A quantity of prepared solvent equal to about 12 to 15 percent of the volume of the oil is then added to the separation tank 18. The process has been tried with about 25 percent solvent, with minimal improvement in oil product quality and a higher disposal and processing load for the solvent. 12-15 percent is therefore believed to be an advantageous amount. The initial water need not be pure water, and thus water can be recycled within the system. The water and oil are then brought to and maintained at about 180° F., typically with a pump 110 and a heater 114, which could be a heat exchanger or the like. The heating loop can draw from the bottom of the tank and return to the top of the tank to help mix the oil and water.

An additional pump 118 can be used to draw liquid from the bottom of the tank and return to the top of the tank to mix the liquid. The mixer 90 is also used. The oil and water are heated and mixed and allowed to reflux for about two hours. The tank construction and mixing methods described have proven to be effective in assuring adequate mixing of the liquids. Insufficient mixing of the liquids does not provide sufficient surface contact and interaction to adequately deash the oil. It may be disadvantageous to mix the liquid too vigorously or for too long as such may form a water and oil emulsion. After mixing the oil and solvent have been mixed, a demulsifier can be added and mixed in the amount of about two gallons of commercially available demulsifier for every 1000 gallons of oil. The liquids are then allowed to settle and separate. Vibrators 122, as have been used on grain silos, may be advantageously attached to the conical section of the tank to aid in separation of the oil and water. Three such vibrators have been used successfully on the present system.

After separation, the oil may be withdrawn from the separation tank 18 as indicated at 126. If a similar quantity of oil 98 and solvent are used each time, a drain pipe may be located at a particular height and used to withdraw oil while leaving layers of asphalt or tar, ash, and water in the cone section of the tank 18. The oil 126 may then be sent to a storage tank and further processed. At this point, the oil 126 is cleaner than typical used oil which has been filtered and dewatered. The ash has been removed and soluble metals are removed from the oil. Typical ash removal is from about 1.5 percent ash to about 0.03 percent ash, which is removal of about 98 percent of the ash. Additionally, the separation process removes the additive packages which are part of lube oil or motor oil and other contaminants. The removal of the ash and contaminants from the oil is a significant step and a process which has not yet been successfully accomplished on a large scale as achieved by applicant.

While such significant improvements have been made to the used oil by removing ash and contaminants, the oil is still primarily useful as a burner oil and thus does not have significantly increased value. The oil is, however, prepared for further processing. Removing the ash and other contaminants aids in successfully processing the oil, such as by distilling.

The water, ash, tar, contaminants, and some oil are drained through the bottom of the separation tank 18 and separated by a filter. Any known filter may be used. The present system uses an API separator. The first API separator chamber currently operates with a belt separator to remove oil from the water. The water passes through a series of weirs to arrive in a second chamber 134. The weirs aid in preventing oil flow from the first chamber 130 to the second chamber 134. A flocculent 138 such as a hydrogel may be added to the water to aid in separation of the impurities from the water.

The oil 142 removed from the water may be stored for processing, and may be distilled with the oil 126. The water and solid contaminants from the API separator are filtered to remove the solids from the water. A screen filter could be used. Currently, a pre-coat filter 146 is used. The pre-coat filter uses a vacuum drum 150 with a layer of diatomaceous earth held to the outer cylindrical surface by vacuum pressure. The water is drawn through the diatomaceous earth as the filter is rotated to remove the solids from the water. The solids are held to the outside of the diatomaceous earth on the cylinder, and can be cut off of the filter bed with a knife. The solids 154 are treated and disposed of as is required. The water may be returned to the solvent tank 102, adjusted for pH by adding more $H_2SO_4$, and reused. Makeup water 106 is added as is necessary.

After a number of cycles, the water is less effective at separating contaminants from the oil, and is not reused. At this point, the water may be used in other ways to reduce water usage and disposal costs. The water may be neutralized 158 and sent to a cooling tower 162, for example. The cooling tower is periodically drained and solids which precipitate from the evaporating water are removed. The separation system discussed above provides an efficient and effective method for removing many types of contaminants including ash from the used oil.

Figure 3:
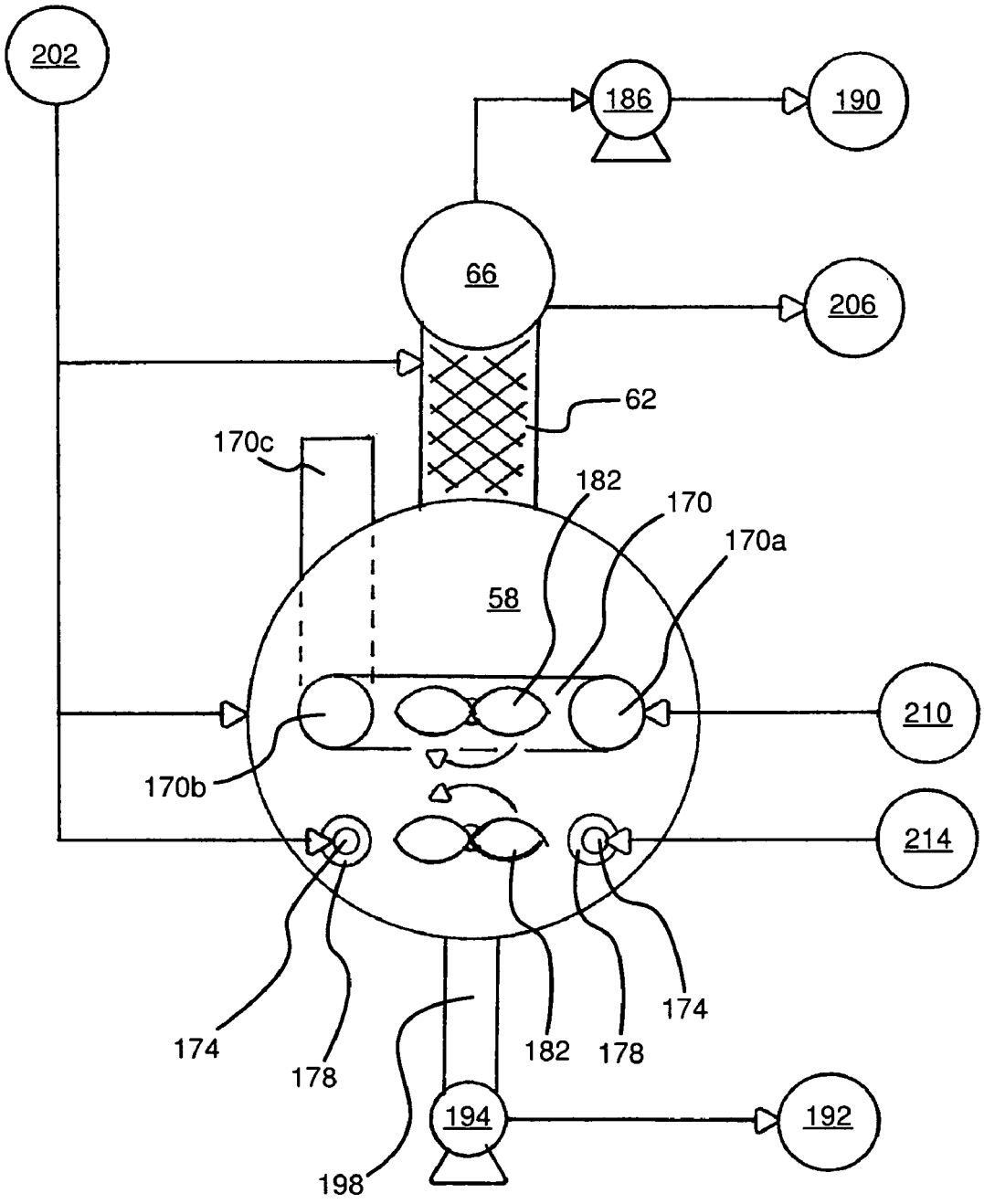
FIG. 3 shows an end cross-sectional view and process diagram for a distillation unit as shown in FIG. 1.

Turning now to FIG. 3, an end cross-sectional view and process diagram of a distillation unit as shown in FIG. 1 is shown. In discussing FIGS. 3, 4, and 5, a single distillation unit is shown for simplicity in describing the features and operation of the distillation unit. The system of the present invention may include multiple distillation units as may be required for a given feed material and the desired separation. The design of the distillation unit shown was achieved in order to refine used oil and produce quality diesel fuel therefrom. As such, the operation will primarily be discussed as relating to that use. It was thereafter discovered that the distillation column was able to separate and distill mixtures which conventional distillation columns were unable to distill. The inventor was brought crude oil which a refinery was unable to cleanly fractionate via distillation, and was able to cleanly distill the crude in the present distillation unit.

The distillation unit includes a distillation pot 58, distillation column 62, and condenser 66 as have been previously discussed. The distillation includes a fire tube or heater 170, including a first leg 170*a*, a second leg 170*b*, and an exhaust stack 170*c*. The distillation pot 58 may alternatively include a heating jacket or shell surrounding all or part of the distillation pot, and which may be filled with steam or heated liquid to heat the distillation pot. Similarly, a heater may be used on the inlet pipes used to carry feed to the distillation pot 58 to preheat the feed materials. Combustion gasses are burned as they flow down the length of the distillation pot 58 in the first leg 170*a*, turn around and flow back down the second leg 170*b*, and are released through the exhaust stack 170*c*. The heater 170 is used to control the temperature in the distillation column. Typically, the distillation is controlled by maintaining a constant heat flux into the distillation column, which may be achieved by maintaining a constant exhaust gas temperature.

The distillation pot 58 also includes one or more sparge lines 174. Presently, a distillation unit is made with two sparge lines of approximately 2 inches in diameter which extend about the length of the distillation pot 58, or about 16 feet. The sparge lines 174 are typically formed with a plurality of ⅛ inch holes in the bottom of the sparge lines. Enough holes may be formed to provide a combined cross sectional area of the holes equal to the cross sectional area of the pipe, i.e. 256 ⅛ inch holes in a 2 inch pipe. An ultrasonic generator 178 (ultrasonic vibrator) may be placed on the sparge lines, typically near where the sparge lines enter the distillation pot 58 or slightly inside the pot 58. The ultrasonic generators 178 may be used to break apart heavier molecules and produce increased amounts of diesel fuel from the used oil.

One or more mixers 182 are used to mix the contents of the distillation pot 58. The mixers are primarily used to ensure movement of the liquid past the heater 170 and sparge lines 174. It has been determined that an optimum rate of movement past the heater 170 for used oil is between 5 and 20 feet per second, and frequently operated at about 6 feet per second. This rate of movement significantly prevents coking of the oil on the heater tubes. Previous attempts to refine used oil and produce products such as diesel fuel have frequently failed as they could not prevent coking inside of the system. Used oil may be more likely to coke because of the residual contaminants in the oil. It has been determined that it is advantageous to run two mixers 182 in opposite directions to achieve good mixing and maintain good circulation and rates of movement in the distillation pot 58.

It was discovered that distillation under vacuum further improved the quality of the distillation and further reduced coking and thermal cracking of the oil. A vacuum pump 186 is therefore used to create a vacuum and to draw off the non-condensable gasses 190 from the system. In distilling used oil, it was discovered that an advantageous level of vacuum was between about 15 inches or water and about 30 inches of water, with about 24 or 25 inches of water being a more advantageous level of vacuum.

It is appreciated that such a level of vacuum within the distillation unit will impede the pumping of bottoms 192 from the distillation pot 58. It has therefore been found advantageous, especially for continuous flow applications, to provide a bottoms pump 194 which is connected to the distillation pot 58 by pipe 198 or the like and located several feet below the distillation pot 58 to provide a greater liquid head pressure at the pump and prevent cavitation in the pump. About six feet of height between the bottoms pump 194 and the distillation pot 58 is often sufficient, but this number may need to be altered according to the level of vacuum in the distillation pot, the desired flow rate through the pump, the requirements of the specific pump chosen, etc. Additionally, the pipe connecting the bottoms pump 194 to the distillation pot 58 must be sized according to the flows necessary and should not restrict flow to the point of dropping pressure and inducing cavitation in the pump. The bottoms pump 194 is then used to pump bottoms product 192 from the distillation pot 58. The bottoms product 192 may be further distilled or processed or stored as a product.

The feed 202 may be pumped into the distillation unit at various locations. The feed 202 may be introduced directly into the distillation pot 58. Alternatively, the feed 202 may be introduced into the distillation column 62 to provide increased contact with the distilling gasses and thereby strip light compounds from the feed and return heavier compounds from the distilling gasses into the distillation pot 58. Additionally, the feed 202 may be introduced into the sparge lines 174. The sparge lines 174 and ultrasonic generators 178 may be used to break compounds in the feed 202 into smaller compounds, as will be discussed in greater detail. Distilling light product 206 is condensed in the condenser 66 and placed into desired product storage containers.

In operating the distillation unit, the fuel 210 provided to the heater 170 may include the non-condensable gasses (which typically include some hydrogen and light hydrocarbons such as butane in addition to air and other gasses) in addition to conventional fuels. The sparge lines 174 may be used to introduce a variety of sparge feed materials 214 into the distillation pot 58, including feed materials, non-condensable gasses, hydrogen, light hydrocarbons, electrolyzed gasses (such as carbon dioxide, carbon monoxide, hydrocarbons, hydrogen, steam, etc.), and other materials.

Figure 4:
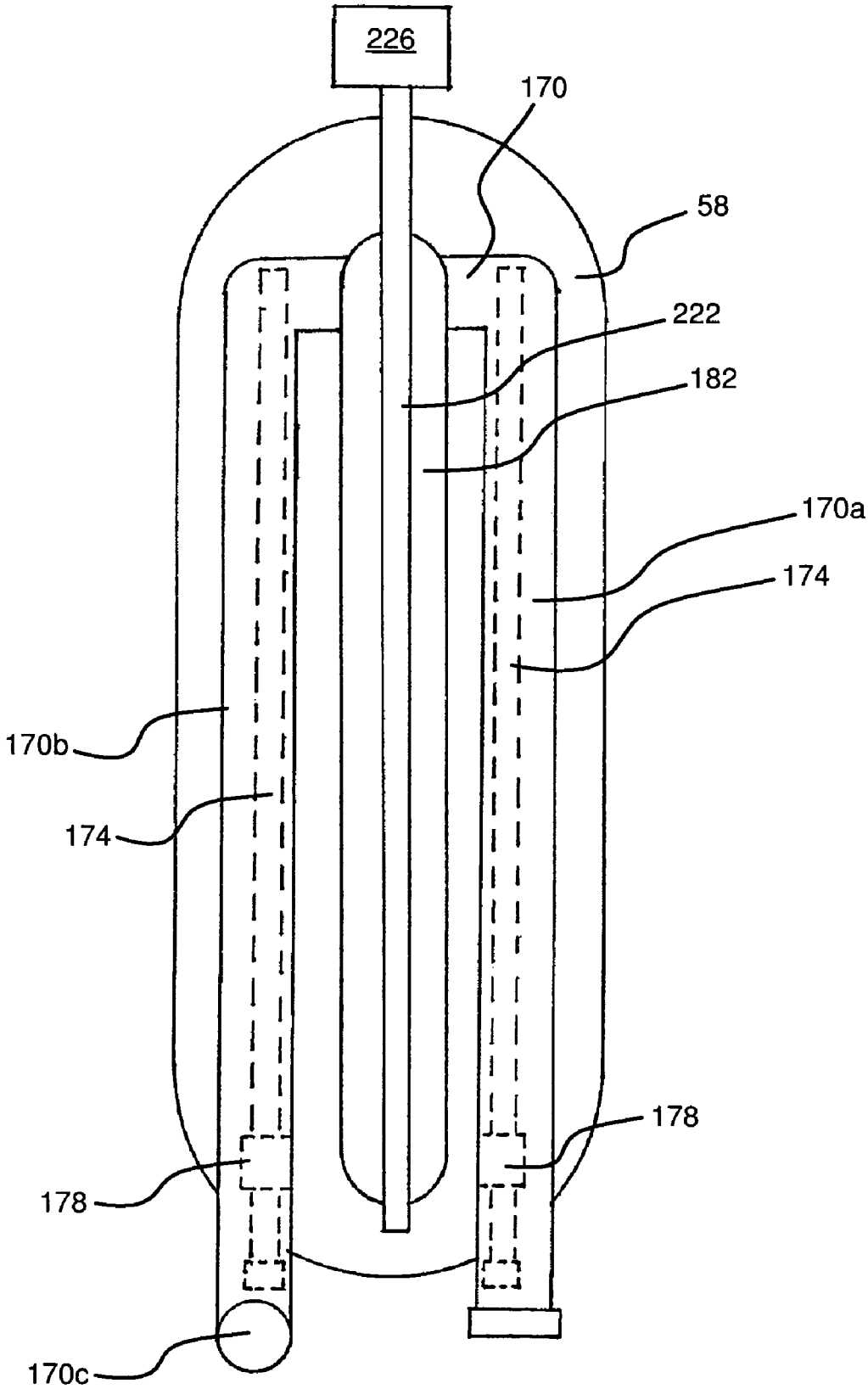
FIG. 4 shows a top cross-sectional view of a distillation unit as shown in FIG. 1.

FIG. 4 shows a top cross-sectional view of the distillation unit of FIG. 1 so as to more clearly illustrate some of the internal features. The heater 170, including the first leg 170*a*, second leg 170*b*, and exhaust stack 170*c* are more clearly visible. The sparge lines 174 and ultrasonic generators 178 (both shown in dashed lines below the heater 170) are also more clearly seen.

The mixer 182 is typically mounted to a shaft 222 which is driven by a motor 226. It is often advantageous that the motor 226 include a variable speed drive so that the mixing speed can be optimized to the feed being distilled. The shaft is supported by bearings or other pivots as necessary. The mixer 182 may be a flat paddle, a plurality of paddles, or various other types of mixing blades to achieve the desired mixing of the distillation pot 58. It is desirable to achieve relatively uniform mixing and to eliminate dead spots in the distillation pot. Such improves the distillation and reduces problems such as coking.

Figure 5:
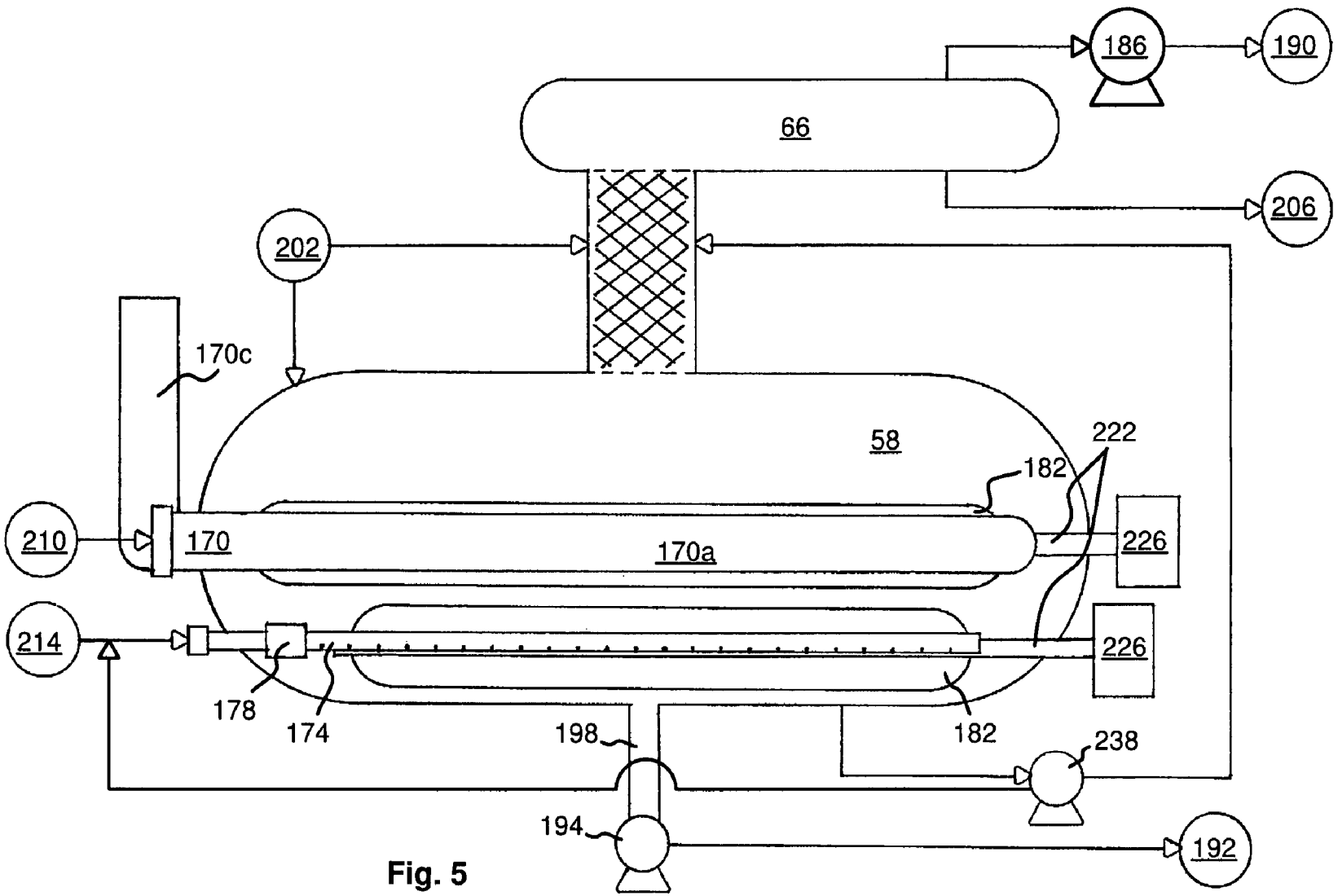
FIG. 5 shows a process diagram of a distillation unit as shown in FIG. 1.

Turning now to FIG. 5, a process diagram of a distillation unit of the present invention is shown. The mixers 182 are shown disposed between the legs 170*a*, 170*b* of the heater 170 and the sparge tubes 174. It is appreciated that the mixer or mixers 182 may extend inwardly from one or both sides, and may be arranged so as to provide effective mixing without interfering with the heater 170 and sparge tubes 174. The sparge tubes are typically placed low in the distillation pot 58 so allow for maximum contact time between liquid in the distillation pot and gasses introduced through the sparge tubes.

A recycle pump 238 may be included if desired. The recycle pump 238 may pump liquid from the distillation pot 58 into the distillation column 62 or sparge lines 174 to increase the activity in those areas as desired.

The several aspects of the distillation unit will now be discussed to explain the advantages of the present invention relative to the refining of used oil to produce diesel, as such was the operating conditions under which the present system was developed. It has been discovered that the present system is not only capable of refining used oil to produce quality fuels and products, but is also capable of distilling and refining other oils and materials which proved difficult or impossible to process using available equipment and methods.

As has been mentioned, prior attempts to refine used oil such as used lube and motor oils have not been successful. These attempts were met with many problems such as the inability to deash the oil and remove impurities from the oil, coking of the oil inside distillation and other equipment, instability of the products produced from the oil including rapid re-oxidation of the oil to a black color, and other problems.

As discussed above, the inventor was able to achieve a separation process whereby additives, metals, ash, and other contaminants were removed from the oil. The process is effective on a large scale, is cost efficient, and is effective at removing a high percentage of these contaminants. Such a process may not be necessary prior to distilling the oil to produce diesel, but is advantageous in eliminating or reducing some of the problems encountered during distillation.

The distillation pot 58 is designed as a combination distillation pot and reactor and may be configured to allow a variety of process to occur within the pot. Initial attempts at distilling the oil and removing the residual water from the oil resulted in excessive foaming of the oil. Excessive foaming would tend to flood the column and adversely affect the quality of the product. To combat the foaming, the distillation column 62 was set up as a packed column with pall rings. The pall rings both impede foaming by dripping condensing distillate back into the pot 58 and improve distillation and separation. While adding the packed column aided considerably with the foaming, the distillate was still unsatisfactory.

Another improvement to the distillation unit was the addition of a vacuum pump 186 and operating the distillation under vacuum. Operation under vacuum allowed for lower distillation temperatures and reduced coking and thermal cracking of the oil. Also, the mixers 182 and the operation of the mixers to provide an adequate flow rate across the heater 170 as discussed further reduces coking and other distillation problems.

Another improvement to the distillation process was made by using the sparge lines 174 to sparge the non-condensable gasses and other gasses into the distillation pot 58. The sparge lines may be used for multiple purposes. Sparging light hydrocarbon gasses into the distillation pot 58 acts as a solvent to increase the yield of diesel and other similar components of the oil. Additionally, the sparge lines may be used to reduce some of the oil to smaller compounds.

As has been mentioned, the sparge lines 174 may be provided with ultrasonic generators 178. The ultrasonic generators tend to break apart oil molecules. Earlier attempts to use ultrasound to break apart oil molecules has been largely unsuccessful, probably because the molecules which have been split apart remain as charged molecules and quickly reattach after exiting the ultrasonic generator. In the present distillation unit, several features are used to increase the effectiveness of the ultrasonic generators. One such element is the operation of the distillation unit under vacuum. It is believed that the vacuum conditions aid in the separation of the lighter components produced by the ultrasound and provides greater time for attachment to another molecule instead of reattachment to the other molecule from which it was separated.

Another aspect contributing to the success of the ultrasonic generator 178 is the introduction of light hydrocarbons and non-condensable gasses into the distillation pot 58. These gasses may combine with the molecules which have been split by the ultrasound. Further, the sparge lines may be used to introduce electrolyzed gasses (such as steam or water, hydrogen, hydrocarbons, carbon monoxide, carbon dioxide, etc.) into the system. These electrolyzed gasses more readily combine with molecules which have been split by the ultrasonic generators. Under such conditions, the ultrasonic generators may be used effectively to break some of the heavier oil components to lighter components which may be distilled as diesel or other quality fuels.

According to one method of operation, the feed oil 202 may be introduced into the distillation pot 58 through the sparge lines 174 and cracked by the ultrasonic generators 178. According to another method of operation, the recycle pump 238 may be used to cycle the oil from the distillation pot 58 through the sparge lines 174 and ultrasonic generators 178. According to another method of operation, gasses including electrolyzed gasses may be introduced through the sparge lines 174 along with the oil so as to provide gasses for recombination with ultrasonically cracked oil molecules to thereby further increase the effectiveness of the ultrasound. By using such methods, ultrasound can be used to effectively crack the heavier oil molecules into lighter molecules and thereby increase the yield of diesel and similar quality fuels.

According to another method of operation, the distillation column 62 may be packed with a catalyst which is effective at cracking oil molecules. Such catalysts are known and have been used in dedicated catalytic crackers. The catalytic distillation column 62 may then be used to crack the oil molecules and produce a higher yield of diesel and other fuels. The feed oil 202 may be introduced into the catalytic distillation column 62. Additionally, recycle pump 238 may be used to reflux oil from the distillation pot 58 through the catalytic distillation column 62. To increase the effectiveness of the catalytic distillation column 62, gasses including the non-condensable gasses, hydrogen, hydrocarbons, electrolyzed gasses, etc. may be introduced through the sparge lines 174. Such gasses will both interact with the contents of the distillation pot 58, but will also flow upwardly through the catalytic distillation column 62, reacting with the oil which may be flowing down through the column.

According to the above methods of operation, the distillation unit may be effectively used to both distill quality products such as diesel fuel and to increase the yield of such products by cracking the oil. It is appreciated that both a catalytic distillation column 62 and an ultrasonic generator 178 on a sparge line 174 may be used.

Another significant advantage of the present invention is the stabilization of the products produced from the used oil. A significant problem encountered by previous attempts to distill used oil to produce quality products. As used herein quality products refers to products which are of marketable quality and which are of comparable quality to products produced from the distillation and processing of virgin crude oil.

While crude oil and used motor oil or used lube oil are typically all black, they are typically black for different reasons. Crude oil is black because of heteroatoms in the hydrocarbon molecules (like sulfur or nitrogen), and in particular the heavy molecules (those with high molecular weights) containing heteroatoms. Heavy molecules containing heteroatoms such as heavy resins or asphaltenes are dark brown or black. Used oil may be black because of some heavy heteroatom containing molecules, but is also black because of oxidized and otherwise degraded molecules and impurities such as metals which are accumulated from the engine or machine in which the oil was used.

Products previously produced from used oil have suffered from instability. For example, diesel distilled from used oil may be produced as the typically light amber liquid, but may quickly oxidize and turn black. The diesel is often oxidized within hours of refining and collecting the diesel. Such is highly undesirable characteristic and does not allow for a quality product.

Applicant has determined that such degradation of the products distilled from used oil can be prevented by carefully distilling a cut of light product and separating this cut from the desired products. Separation of this light cut from the remaining oil and from the subsequently produced products allows for production of a product which is stable and does not reoxidize even after significant periods of time.

It has been determined that careful distillation and removal of a cut obtained while distilling between temperatures of about 200° F. and about 400° F. prevents the reoxidization and blackening of the remaining fuels and products. This distillation cut is removed between these temperatures while distilling under vacuum as described above, and preferably at a vacuum of about 24 or 25 inches of water. After removal of this cut, distillation may proceed as desired by gradually heating and distilling the remaining oil, and performing any other operations as described herein. This cut is herein defined and referred to as an "oxidizing light cut." Thus, as used herein, the term "oxidizing light cut" refers to the light cut which, if left in the distillation products causes them to turn black, and which may be removed from the used oil by distillation at a vacuum pressure of about 24 to 25 inches of water and at this pressure distilled off during the temperature range between about 200° F. and 400° F. It is appreciated that these same compounds can be distilled out of the used oil at different combinations of pressure and temperature as understood by those skilled in distilling. Thus, at a lower pressure (a higher amount of vacuum applied to the system) these compounds would distill off during a lower temperature range, and at a higher pressure (a lower amount of vacuum, atmospheric pressure, or even at higher than atmospheric pressure) these compounds would distill off during a higher temperature range.

Figure 6:
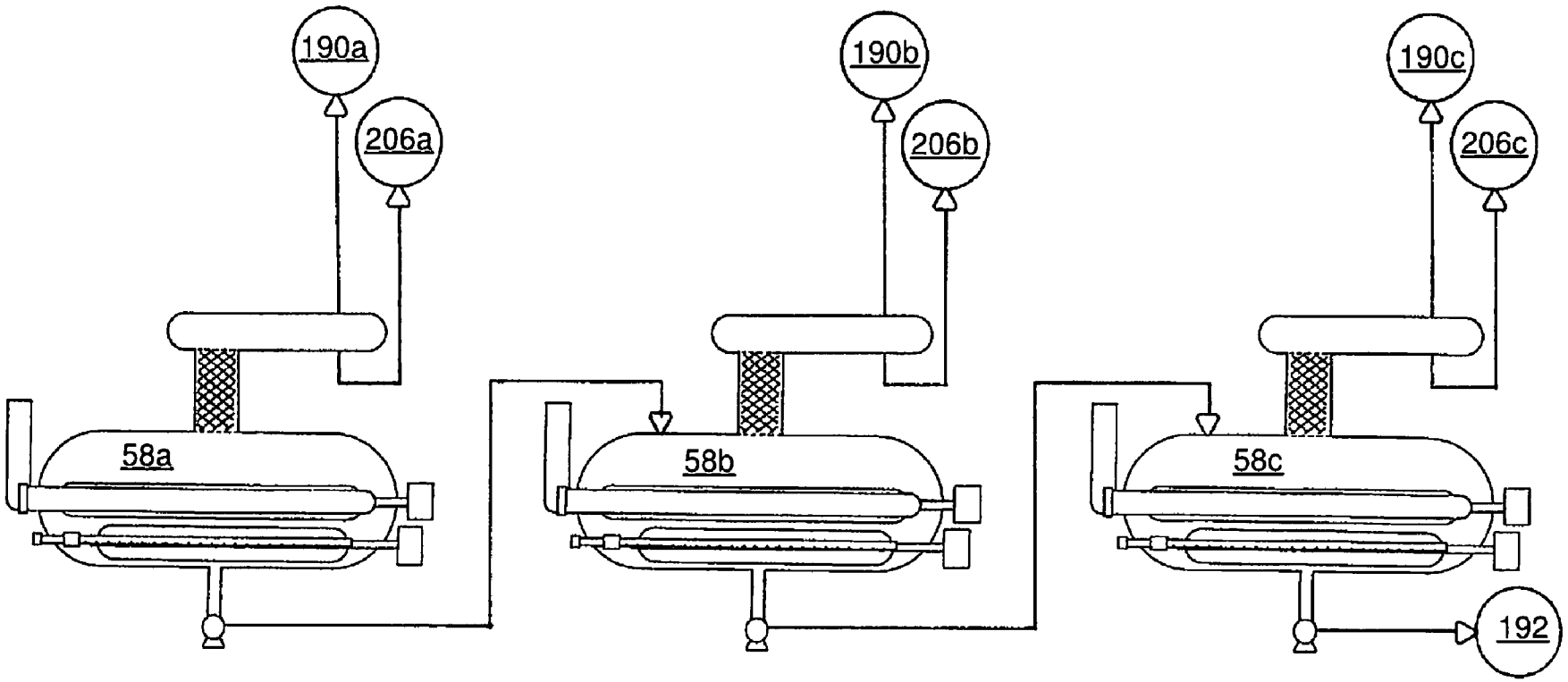
FIG. 6 shows a process diagram of multiple distillation units as shown in FIG. 1.

Turning now to FIG. 6, a process diagram further illustrating the distillation unit of FIG. 1 is shown. As mentioned previously, the distillation unit in FIG. 1 as well as the detailed illustrations of the distillation unit in the previous figures are each illustrated as a single unit as multiple units can not be shown due to space constraints and due to the requirements of showing the individual features and details of an individual unit.

The distillation unit shown in FIG. 1 can be operated as a single distillation unit, multiple distillation units operating in parallel (roughly equivalent to a larger distillation unit), multiple distillation units operating in series (allowing multiple types of products in a continuous or semi continuous flow), or a combination of series and parallel distillation units. The decision regarding how many distillation units are required and in what configuration to operate these units depends on the production requirements. Such requirements include the necessary production rates, the number of products produced from a feed material or combination of feed materials, the desire for batch operation, semi-continuous operation, or continuous flow operation, the relative flow rates between stages of distillation units, etc.

FIG. 6 illustrates a plurality of distillation pots 58*a*, 58*b*, 58*c*, each having the associated structures discussed in reference to the above Figures. Each distillation pot 58*a*, 58*b*, 58*c* may produce amounts of non-condensable gasses 190*a*, 190*b*, 190*c* and distillate products 206*a*, 206*b*, 206*c*. Each distillation pot 58*a*, 58*b*, 58*c* also produces a bottoms product. Typically, multiple distillation stages are configured to separate the first boiling distillate product 206*a* in the first distillation pot 58*a*, and the bottoms product is transferred to the second distillation pot 58*b* where a second boiling distillate product 206*b* is removed.

The process continues through the necessary distillation stages in this manner until a final bottoms product 192 is produced. This method is typically used for efficiency in heating the mixture to remove the distillate products. In some cases, it is desirable to transfer a distillate product to another distillation unit for subsequent processing, and/or to separate a bottoms product as a final product. It is thus appreciated that such an arrangement depends on the mixture being refined, and the present invention is fully capable of performing the process.

The details of each of the distillation stages are not shown, but it is appreciated that each distillation unit may have all of the features and operations capability discusses above.

In the production of products such as diesel fuel from used oil, the distillation unit may comprise a single distillation unit or multiple distillation units in series. Parallel units are not discussed, as these typically are used to add flow capacity to any particular stage of distillation.

If the used oil is to be simply separated into a single product such as diesel and remainder bottoms product, a single distillation unit may be used in batch or semi-continuous flow. Typically, the batch or oil is introduced into the distillation unit. The above discussed light cut is removed to stabilize and eliminate the reoxidization of the products. The oil is then further distilled to remove the desired product, such as diesel. The remaining bottoms product is removed from the distillation pot.

Such a distillation may separate the oil into quality diesel fuel and a remainder bunker oil which is usable as a burner type oil. This process is advantageous as both portions of the oil are usable and may be sold as products, even if the remainder bunker oil does not have the same value as the diesel fuel. The process is further advantageous as it is simple.

This process may be accomplished in a continuous flow by using multiple distillation units. The first distillation unit may operate at about 400° F. and remove the oxidizing light cut to allow subsequent production of a quality diesel fuel or other desired product. The remainder oil (bottoms product) is sent as to the second distillation unit which operates at the desired temperature for distilling the desired product. The bottoms product from this distillation unit may be kept as the final bottoms product, or sent to a subsequent distillation unit for further separation into two products. It is thus appreciated that multiple distillation units may be attached together to produce multiple types of products from the feed material.

Additionally, the distillation units of the present invention may be operated to produce additional amounts of product by using a catalytic distillation column (62, FIG. 5), or an ultrasonic sparge line (174, FIG. 5), or both. Such a process may be a batch process in a single distillation pot and may occur in several forms. In one method, the oxidizing light cut may be removed, and then the distillation may proceed using the ultrasonic generator and/or catalytic distillation column to produce a product and a remainder bottoms product. Alternatively, the process may include removal of the oxidizing light cut, removal of a diesel cut or other desired product, and subsequent removal of another cut with use of the catalytic column and/or the ultrasonic generator, and production of a bottoms product.

This process may also occur in multiple distillation pots as a continuous process. The first distillation unit may be used to remove the oxidizing light cut. A second distillation unit may remove a product cut such as diesel, or may also remove a product cut which includes the distilled product and product produced with simultaneous use of a catalytic column and/or an ultrasonic generator. A third distillation pot may remove a product again produced by conventional distillation or through use of a catalytic column and/or ultrasonic generator. It is appreciated that by combining various distillation stages, various types of products may be produced, including a residual bottoms product.

The present invention provides methods and equipment which is capable of not only producing quality products such as diesel fuel, but is capable of converting the heavier oil fractions into lighter products such as diesel. As such, the decision must be made as to how far it is desirable to process the oil. A simple process producing diesel and bunker oil is advantageous as it is simpler and requires fewer steps, and because the bunker oil may be transported and utilized with minimal heating and effort. A different process, such as using a catalytic column and/or ultrasonic generator to produce additional light products, typically results in a heavier bottoms product in addition to a greater yield of light products. The heavier bottoms product might be a tar or might even be a crystalline solid depending on the extent of processing. It must be considered what the usability of this residual product is, how difficult to transport and use the product is, and how expensive it is to dispose of the product if the product has no significant market value.

It is appreciated that the above system has great usefulness outside of processing used oil. For example, the inventor has been brought crude oil from refineries which the refineries have been unable to properly fraction through their conventional distillation equipment. Using the present equipment, the inventor was able to distill the crude into cleanly separated fractions. Additionally, the inventor has been able to distill various other difficult to separate mixtures, such as glycol mixtures.

Figure 7:
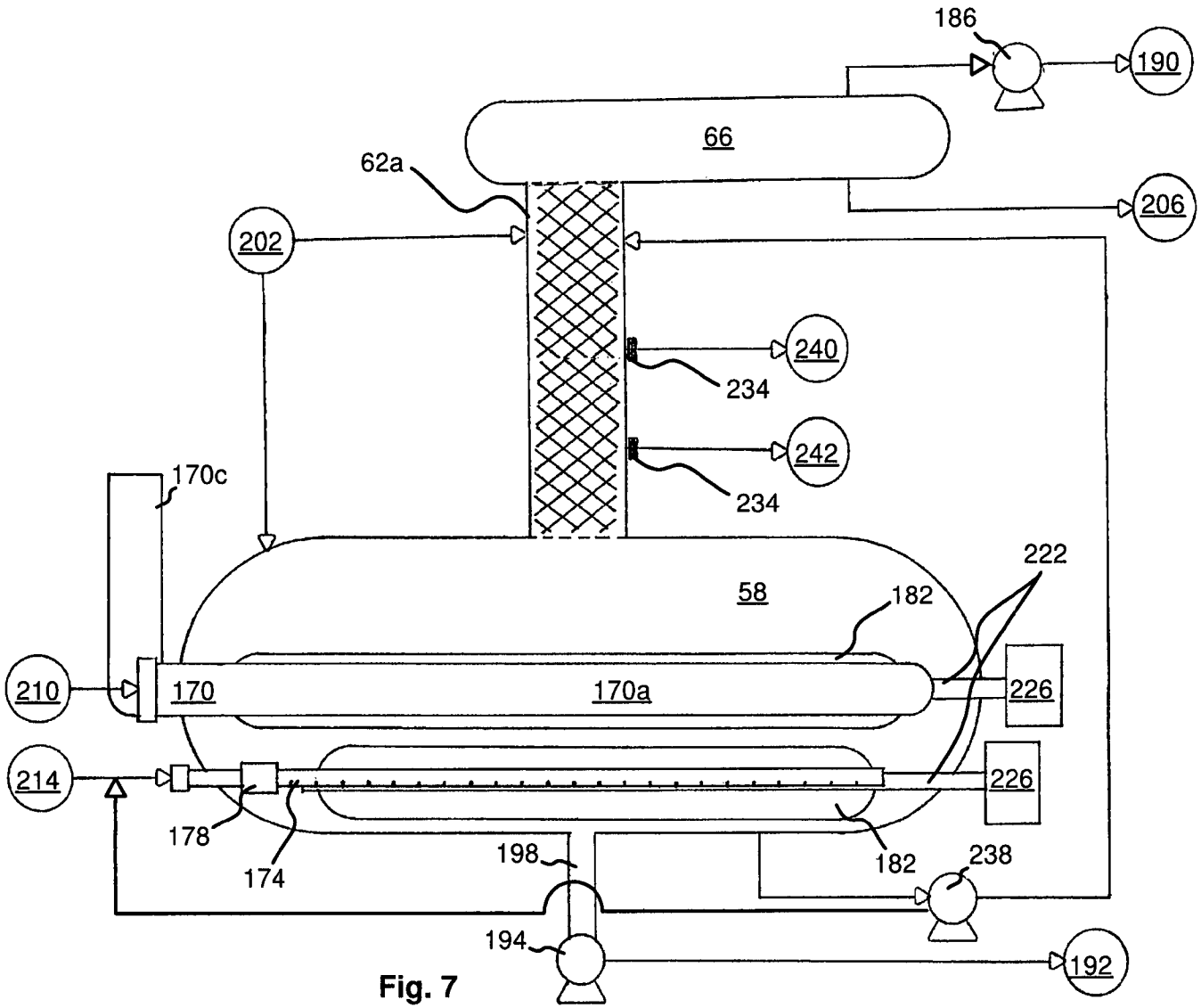
FIG. 7 shows another process diagram of a distillation unit as shown in FIG. 1.

Turning now to FIG. 7, another process diagram of the distillation unit of FIG. 1 is shown. The distillation unit is similar to that of FIG. 5 and is labeled accordingly. The distillation column 62*a* is different, and includes outlets 234 for removing distillation products from various locations in the distillation column 62*a*. The products from outlets 234 may be placed in storage containers 240, 242, or may be feed to other pieces of equipment as is desired. The distillation column 62*a* may be operated to achieve a temperature profile wherein the bottom of the column is about the temperature of the distillation pot 58 and the top of the column is about the temperature of the condenser, or of the condensing top product. If desired, the material in the distillation column 62*a* (lighter compounds distilled from the pot 58) may be split into a number of different fractions. To achieve a good separation into the desired fractions, the distillation column 62*a* may be made taller. The column may be constructed in sizes such as between 4-20 feet. For many compounds, good separation is achieved in a distillation column 62*a* which is about 10-12 feet tall. The column 62*a* may be made with collection plates or trays inside at the appropriate heights in the column to collect the desired liquid. The collection plates or trays may be connected to a valve or the like to regulate the amount of liquid being drawn therefrom if desired. It will be appreciated that if the column 62*a* and distillation pot 58 are operated under vacuum, that vacuum may need be applied to the storage tanks 240, 242 or pumps utilized to move the products into their respective storage tanks. The distillation apparatus may thus be used to produce multiple products at once by splitting the distillate into various desired products.

The distillation apparatus may be utilized for many advantageous processes. For example, the distillation apparatus may be used to distill the petroleum extract from tar sands. The tar may be distilled to produce about 65-70 percent of the tar as a diesel fuel type top product. The distillation apparatus may be used to separate crude oil into a diesel fuel and a bottoms oil at the field. The diesel fuel cut may be sent to market, eliminating steps in transporting the fuel, and the bottoms oil may be sent to a refinery for processing.

Figure 8:
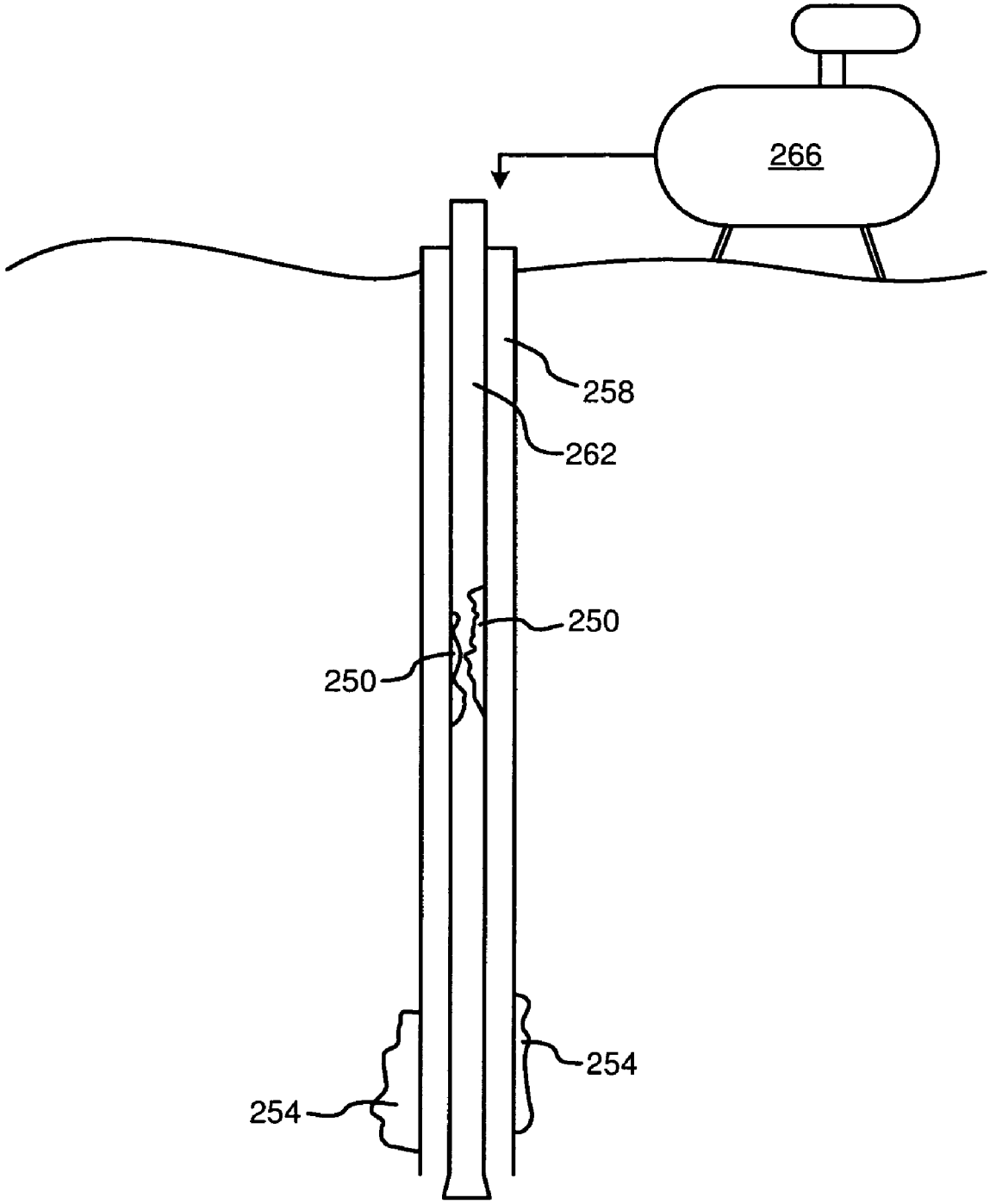
FIG. 8 shows a schematic diagram of an oil well.

The present apparatus may be used to treat and prevent paraffin deposits in an oil well. Turning now to FIG. 8, a schematic diagram of an oil well and of the distillation apparatus is shown. In a well, it is not uncommon for paraffin deposits 250 to accumulate inside the production pipe 262, reducing flow and production. These deposits often occur in a cold zone of the geological formation, or the like. Additionally, paraffin deposits 254 may occur in the oil producing rock zones, reducing the flow of oil from the rock and into the well.

Typically, this problem is addressed by pumping heated diesel or steam into the well bore 258 to melt the paraffin deposits 250 as the diesel flows past the deposits on the outside of the production pipe 262. Diesel, however, has too low of a flash point to be highly effective in removing the paraffin deposits 250. The steam is also problematic in that it must be separated from the produced oil and results in waste water which must be treated.

According to the present invention, a mixture may be made which is much more effective in eliminating the paraffin deposits 250, 254 from the well. A viscosity additive may be made by mixing a winter diesel fuel additive with diesel or kerosene (which is preferred). The fuel additive is of the type to prevent diesel from becoming too viscous in the winter. About 1 quart of fuel additive is mixed with about 1000 gallons of kerosene to create a viscosity enhancer. A crude oil is then distilled in the distillation apparatus 266 (as previously discussed) to distill the light ends off of the crude. The crude is often distilled under vacuum to reduce the temperature effects on the crude oil. The crude is distilled to a desired temperature to raise the flash point of the bottoms product, which is then used for the paraffin treatment. The crude may typically be distilled to temperatures of between 250 and 600 degrees Fahrenheit to correspondingly raise the flash point.

Depending on how high the distillation temperature is, between 25-75 percent of the crude may be distilled off as a diesel type oil, and the bottoms may be between 25-75 percent of the crude oil by volume. Preferably, the crude oil is distilled to a temperature of about 500 degrees Fahrenheit which, for a sweet light crude of about a 34 API gravity, results in about 70 percent of the crude being distilled off as a diesel type top product. The bottoms product is them mixed with the previously prepared viscosity enhancer using about 10 percent viscosity enhancer and 90 percent of the bottoms product. The mixture is then heated to about 450 degrees Fahrenheit and is injected into the well bore 258. As the mixture flows down the well bore 258, it melts the paraffin deposits 250, and even dissolves paraffin deposits 254 in the oil production zones, improving production from the well.

For wells which are clogged with paraffin deposits, about 5000 gallons of the mixture may be injected into the well. Thereafter, about 100 gallons per day may be injected to prevent paraffin accumulation. The mixture has been found to have a very high ability to dissolve paraffin. The mixture has been used to dissolve a roughly equal volume of solid paraffin in laboratory experiments.

In making the mixture, it had been found that the crude oil mixture is advantageous over diesel or steam as it has a much greater ability to dissolve paraffin and does not impose any waste treatment requirements. The paraffin treatment mixture produced from the well may be refined as is desired as a crude oil and need not be separated from the crude oil. It was discovered when formulating the paraffin treatment mixture that the winter diesel fuel additive is effective in reducing the viscosity of the mixture, but should be mixed with diesel or preferably kerosene first for maximum effectiveness.

There is thus disclosed an improved method and system for refining and distilling chemicals, and an improved method and system for refining used oil to produce high quality products such as diesel fuel. The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A method comprising:

selecting a quantity of used oil;

selecting a distillation apparatus;

placing the quantity of used oil within the distillation apparatus;

removing an oxidizing light cut from the quantity of used oil in a first distillation process, thereby leaving a first remainder within the distillation apparatus;

raising, after the removing, the temperature of the first remainder; and separating, after the raising, diesel fuel from the first remainder in a second distillation process, thereby leaving a second remainder within the distillation apparatus, the diesel fuel maintaining a substantially constant color independent of time.

2. The method of claim 1, wherein the distillation apparatus comprises at least one ultrasonic generator.

3. The method of claim 2, further comprising inducing, by the ultrasonic generator, ultrasonic vibrations within at least one of the quantity of used oil and the first remainder.

4. The method of claim 3, wherein the distillation apparatus further comprises at least one sparge line comprising a conduit penetrated by a plurality of apertures.

5. The method of claim 4, further comprising circulating at least a portion of the quantity of used oil or the first remainder through the at least one sparge line.

6. The method of claim 5, wherein the distillation apparatus further comprises the at least one ultrasonic generator positioned proximate the at least one sparge line.

7. The method of claim 6, wherein the first and second distillation processes operate under a vacuum pressure.

8. The method of claim 7, wherein the vacuum pressure is in the range from about 15 inches of water to about 30 inches of water.

9. The method of claim 1, wherein the distillation apparatus further comprises at least one sparge line comprising a conduit penetrated by a plurality of apertures; and the method further comprises circulating at least a portion of the quantity of used oil or the first remainder through the at least one sparge line.

10. The method of claim 9, wherein the distillation apparatus further comprises at least one ultrasonic generator positioned proximate the at least one sparge line.

11. The method of claim 1, wherein the first and second distillation processes operate under a vacuum pressure in the range from about 15 inches of water to about 30 inches of water.

12. The method of claim 1, wherein the first distillation process comprises maintaining the quantity of used oil at a temperature between about 200° F. and about 400° F.

13. The method of claim 1, wherein the second distillation process comprises maintaining the first remainder at a temperature above about 400° F.

14. The method of claim 1, further comprises sparging a gas into at least one of the quantity of used oil and the first remainder.

15. The method of claim 14, wherein the gas is selected from the group consisting of non-condensable gasses produced during one of the first and second distillation processes, hydrogen, light hydrocarbons, electrolyzed water vapor, electrolyzed hydrogen, electrolyzed carbon dioxide, and electrolyzed light hydrocarbons.

16. The method of claim 1, further comprises passing a portion of at least one of the quantity of used oil and the first remainder through a catalytic bed located inside the distillation apparatus.

17. The method of claim 1, wherein:

the distillation apparatus comprises at least one ultrasonic generator; and the method further comprises passing at least a portion of the quantity of used oil or the first remainder proximate the at least one ultrasonic generator.

18. The method of claim 1, wherein:

the distillation apparatus comprises at least one ultrasonic generator;

the method further comprises sparing a gas into at least one of the quantity of used oil and the first remainder; and the method further comprises passing the gas and at least a portion of at least one of the quantity of used oil and the first remainder proximate the at least one ultrasonic generator.

19. A method comprising:

applying a quantity of used oil to a molecular sieve to obtain a permeative product and a non-permeative product;

placing one of the permeative product and the non-permeative product within a distillation apparatus;

removing an oxidizing light cut from one of the permeative product and the non-permeative product in a first distillation process, thereby leaving a first remainder within the distillation apparatus;

raising, after the removing, the temperature of the first remainder; and separating, after the raising, diesel fuel from the first remainder in a second distillation process, thereby leaving a second remainder within the distillation apparatus.

20. A method comprising:

cleaning a quantity of used oil by mixing therewith a solution of water and sulfuric acid;

separating, after the cleaning, the solution from the quantity of used oil;

applying the quantity of used oil to a molecular sieve to obtain a permeative product and a non-permeative product;

placing one of the permeative product and the non-permeative product within a distillation apparatus comprising at least one ultrasonic generator;

removing an oxidizing light cut from one of the permeative product and the non-permeative product in a first distillation process, thereby leaving a first remainder within the distillation apparatus;

raising, after the removing, the temperature of the first remainder;

separating, after the raising, diesel fuel from the first remainder in a second distillation process, thereby leaving a second remainder within the distillation apparatus, the diesel fuel maintaining a substantially constant color independent of time;

sparging a gas into at least one of the quantity of used oil and the first remainder; and passing the gas and at least a portion of at least one of the quantity of used oil and the first remainder proximate the at least one ultrasonic generator.

* * * * *